US005963774A

United States Patent [19]

Sasaki et al.

[11] Patent Number: 5,963,774

[45] Date of Patent: Oct. 5, 1999

[54] METHOD FOR PRODUCING CAST ALLOY AND MAGNET

[75] Inventors: Shiro Sasaki; Hiroshi Hasegawa; Yoichi Hirose, all of Saitama, Japan

[73] Assignee: Showa Denko K.K., Tokyo, Japan

[21] Appl. No.: 09/065,564

[22] Filed: Apr. 24, 1998

Related U.S. Application Data

[62] Division of application No. 08/838,784, Apr. 10, 1997.

[30] Foreign Application Priority Data

Apr. 10, 1996 [JP] Japan ..... 8-113085

[51] Int. Cl.[6] ..... B22F 3/12

[52] U.S. Cl. ..... 419/33; 419/38; 148/302; 420/83; 420/121

[58] Field of Search ..... 419/33; 148/302; 420/83, 121

[56] References Cited

U.S. PATENT DOCUMENTS

| | | | |
|---|---|---|---|
| 4,859,254 | 8/1989 | Mizoguchi et al. | 148/302 |
| 4,888,068 | 12/1989 | Tokunaga et al. | 148/104 |
| 5,022,939 | 6/1991 | Yajima et al. | 148/302 |
| 5,049,208 | 9/1991 | Yajima et al. | 148/302 |
| 5,071,493 | 12/1991 | Mizoguchi et al. | 148/302 |
| 5,383,978 | 1/1995 | Yamamoto et al. | 148/101 |
| 5,405,455 | 4/1995 | Kusunoki et al. | 148/103 |
| 5,595,608 | 1/1997 | Takebuchi et al. | 148/104 |

FOREIGN PATENT DOCUMENTS

| | | |
|---|---|---|
| 0 255 939 | 2/1988 | European Pat. Off. . |
| 0 348 038 | 12/1989 | European Pat. Off. . |
| 0 517 179 | 12/1992 | European Pat. Off. . |
| 0 657 899 | 6/1995 | European Pat. Off. . |
| 63-317643 | 12/1988 | Japan . |
| 8-264363 | 10/1996 | Japan . |
| 8-269643 | 10/1996 | Japan . |

OTHER PUBLICATIONS

Patent Abstracts of Japan vol. 013, No. 166 (E–746), Apr. 20, 1989 & JP 64 000706 A (Tokin Corp.), Jan. 5, 1989.

Patent Abstracts of Japan vol. 095, No. 010, Nov. 30, 1995 & JP 07 176414 A (TDK Corp), Jul. 14, 1995.

*Primary Examiner*—Ngoclan Mai

*Attorney, Agent, or Firm*—Armstrong, Westerman, Hattori, McLeland & Naughton

[57] ABSTRACT

The magnetic properties of rare earth magnet are improved by means of forming a novel structure of the cast alloy used for the production of a rare earth magnet, which contains from 27 to 34% by weight of at least one rare earth element (R) including yttrium, from 0.7 to 1.4% by weight of boron, and the balance being essentially iron and, occasionally any other transition element, and comprises an $R_2T_{14}B$ phase, an R-rich phase and optionally at least one ternary phase except for the $R_2T_{14}B$ phase and the R-rich phase. The novel structure is that the volume fraction (V) in percentage of said $R_2T_{14}B$ phase and said at least one ternary phase is more than 138–1.6r (with the proviso that r is the content of R), the average grain size of the $R_2T_{14}B$ phases is from 10 to 100 $\mu$m and, further, the average spacing between the adjacent R-rich phases is from 3 to 15 $\mu$m. The novel structure can be formed by by means of feeding alloy melt onto a rotary casting roll, cooling in a temperature range of from melting point to 1000° C. at a cooling rate of 300° C. per second or more, and further cooling in a temperature range of from 800 to 600° C. at a cooling rate of 1° C./second or less.

4 Claims, 2 Drawing Sheets

METHOD FOR PRODUCING CAST ALLOY AND MAGNET

This application is a division of prior application Ser. No. 08/838,784 filed Apr. 10, 1997.

BACKGROUND OF INVENTION

1. Field of Invention

The present invention is related to a cast alloy used for the production of a permanent magnet, which contains rare-earth elements, and to a method for producing the cast alloy. The present invention is also related to a method for producing a rare earth magnet.

2. Description of Related Art

The production amount of rare earth magnets is steadily increasing along with miniaturization and Derformance enhancement of electronic appliances. In particular, the production amount of NdFeB magnets is continuously increasing, because it is superior to the SmCo magnet in the aspects of high performance and low material cost. Meanwhile, demand for the NdFeB magnets, performance of which has been further enhanced, is increasing.

The ferromagnetic phase of the NdFeB magnet, which plays an important role in realizing the magnetic properties, is the $R_2T_{14}B$ phase. This phase is referred to as the main phase. There is also present in the NdFeB magnet a non-magnetic phase, which includes rare earth elements, such as Nd or the like, in high concentration. This phase is referred to as the R-rich phase and also plays an important role as follows.

(1) The R-rich phase has a low melting point and hence is rendered to a liquid phase in the sintering step of the magnet production process. The R-rich phase contributes therefore to densification of the magnet and hence enhancement of magnetization.

(2) The R-rich phase eliminates the defects of the grain boundaries of the $R_2T_{14}B$ phase, which defects lead to the nucleation sites of reversed magnetic domains. The coercive force is thus enhanced due to decreasing to the nucleation sites.

(3) Since the R-rich phase is non-magnetic, the main phases are magnetically isolated from one another. The coercive force is thus enhanced.

It will be understood from the roles mentioned above that, when the dispersion of the R-rich phase is insufficient to cover the grain boundaries of the main phases, local reduction of the coercive force occurs at the non-covered grain-boundaries, and hence the squareness ratio of the magnet is impaired. Furthermore, since the sintering properties are impaired, the magnetization and hence the maximum energy product are lowered.

Meanwhile, since the proportion of the $R_2Fe14B$ phase, i.e., the ferromagnetic phase, should be increased in the high-performance magnet, the volume fraction of the R-rich phase inevitably decreases. In many cases, however, such attempted increase in the fraction of $R_2Fe_{14}B$ does not necessarily attain high performance, because the local insufficiency or the R-rich phases is not solved. A number of studies have, therefore, been published on how to provide a method for preventing the performance reduction due to the insufficient R-rich phase. They are roughly classified into two groups.

One group proposes to supply the main $R_2Fe_{14}B$ phase and the R-rich phase from separate alloys, respectively. This proposal is generally referred to as the two-alloy blending method. An alloy magnet having a particular composition can be produced by the two-alloy blending method using the two alloys, composition of which can be selected in a wide range. Particularly, one of the alloys, i.e., the alloy for supplying the R-rich phase, can be selected from a large variety of compositions and can be produced by various methods. Several interesting results have accordingly been reported.

For example, an amorphous alloy, which is rendered to a liquid phase at the sintering temperature, can be used as one of the alloys for supplying the grain-boundary phase (hereinafter referred to as "the boundary phase alloy"). In this case, since the amorphous alloy is under a non-equilibrium state, the Fe content of this alloy is adjusted to a higher level than that of the ordinary R-rich phase composition. When a magnet is to be produced by using the amorphous boundary-phase alloy, the mixing ratio of the boundary-phase alloy can be made high corresponding to high Fe content of the amorphous boundary phase alloy. As a result, when the R-rich phases are formed at the sintering steps, they are well dispersed and hence the magnetic properties are successfully enhanced. Furthermore, the amorphous alloy can effectively suppress the powder oxidation (E. Otsuki, T. Otsuka and T. Imai, 11th International Workshop on Rare Earth Magnet and Their Application Vol. 1, p 328 (1990)).

According to another report, a high-Co alloy is used as the boundary phase alloy to successfully prevent the powder oxidation (M. Honshima and K. Ohashi, Journal of Materials Engineering and Performance, Vol. 3(2), April 1994, p218–222).

The other group proposes the strip casting of the final composition alloy. This method realizes a higher cool-no rate than by the conventional metal-mold casting method and hence enables to finely disperse the R-rich phases in the alloy structure produced. Since the R-rich phases are finely dispersed in the cast alloy, their dispersion after crushing and sintering is also excellent so as to successfully improve the magnetic properties (Japanese Unexamined Patent Publications Nos. 5–222,488 and 5-295,490).

Apart from the discussions hereinabove, since the volume fraction of $R_2T_{14}B$ phase is high in the high-performance magnet, its composition becomes close to the stoichiometeric $R_2T_{14}B$ composition. The α—Fe is liable to form. The α—Fe in the powder incurs reduction in crushing efficiency in the magnet production. If the α—Fe remains in the magnet after sintering, the magnet performance is lowered. The α—Fe must, therefore, be diminished by means of homogenizing heat-treatment of an ingot for a long period of time, if the ingot is produced by the conventional metal-mold casting. The strip casting method is advantageous over the metal-mold casting method, because the precipitation of α—Fe is suppressed by means of increasing the solidification rate and hence super-cooling the alloy to beneath the peritectic-reaction temperature.

The two-alloy blending method and the strip casting method can be so combined that the main-phase alloy and an alloy with low R content are strip cast. Even in this case, although the R content is so low as to form α—Fe, the effects of the strip casting, i.e., the suppression of α—Fe formation and the enhancement of crushing efficiency, are recognized.

When the alloy having a relatively low R content and containing $R_2T_{17}$ is used in the two-alloy blending method, the R content of the main-phase alloy is correspondingly high. Even if the main-phase alloy is cast by the conventional metal-mold casting method, the formation amount of α—Fe is considered to be small. When such main-phase alloy is cast by the strip casting method, since α—Fe formation is thoroughly suppressed, extremely good crushing property and good grain dispersion are attained. The strip casting combined with the two-alloy blending method also improves the dispersion of the R-rich phases (Japanese Unexamined Patent Publication No. 7-45,413).

SUMMARY OF INVENTION

As is described hereinabove, the two-alloy blending method, the strip-casting method, and the combined, two-alloy blending and strip-casting method attain good dispersion of the R-rich phase after sintering and hence improvement in the magnetic properties. The magnetic properties do not attain, however, the required level. It is, therefore, an object of the present invention to furthermore improve the prior art method, in such a manner that high magnetic properties, particularly high residual magnetization (Br), are stably realized.

In accordance with the objects of the present invention, there is provided a cast alloy used for the production of a rare earth magnet (hereinafter referred to as "the inventive cast alloy") which contains from 27 to 34% by weight of at least one rare earth element (R) including yttrium, from 0.7 to 1.4% by weight of boron, and the balance being essentially iron and, occasionally any other transition element, and comprises an $R_2T_{14}B$ phase, an R-rich phase and optionally at least one ternary phase except for the $R_2T_{14}B$ phase and the R-rich phase, characterized in that the volume fraction (V) in percentage of said $R_2T_{14}B$ phase and said at least one ternary phase is more than 138−1.6r (with the proviso that r is the content of R), the average grain size of the $R_2T_{14}B$ phases is from 10 to 100 μm and, further, the average spacing between the adjacent R-rich phases is from 3 to 15 μm.

Cast alloys according to the embodiments of the present invention include the following.

(1) An inventive cast alloy, which contains from 28 to 33% by weight of at least one rare earth element (R) including yttrium, from 0.95 to 1.1% by weight of boron, and the balance being essentially iron and, occasionally any other transition element, characterized in that the volume fraction (V') in percentage of said $R_2T_{14}B$ phase is in the range of from $138-1.6r<V'<95$, the average grain size of the $R_2T_{14}B$ phases is from 10 to 50 μm and, further, the average spacing between the adjacent R-rich phases is from 3 to 10 μm.

(2) A cast alloy according to (1), which contains from 30 to 32% by weight of at least one rare earth element (R) including yttrium, from 0.95 to 1.05% by weight of boron, and the balance being essentially iron and, occasionally any other transition element, characterized in that the volume fraction (V') in percentage of said $R_2T_{14}B$ phase is in the range of from $138-1.6r<V'<95$, the average grain size of the $R_2T_{14}B$ phases is from 15 to 35 μm and, further, the average spacing between the adjacent R-rich phases is from 3 to 8 μm.

(3) An inventive cast alloy, which contains from 27 to 30% by weight of at least one rare earth element (R) including yttrium, from 0.95 to 1.4% by weight of boron, and the balance being essentially iron and, occasionally any other transition element, characterized in that the volume fraction (V') in percentage of said $R_2T_{14}B$ phase is more than 91, the average grain size of the $R_2T_{14}B$ phases is from 15 to 100 μm and, further, the average spacing between the adjacent R-rich phases is from 3 to 15 μm.

(4) A cast alloy according to (3), which contains from 28 to 29.5% by weight of at least one rare earth element (R) including yttrium, from 1.1 to 1.3% by weight of boron, and the balance being essentially iron and, occasionally any other transition element, characterized in that the volume fraction (V') in percentage of said $R_2T_{14}B$ phase is more than 93, the average grain size of the $R_2T_{14}B$ phases is from 20 to 50 μm and, further, the average spacing between the adjacent R-rich phases is from 5 to 12 μm.

In accordance with the present invention, there is provided a method of producing a cast alloy, characterized in that melt having one of the above mentioned compositions is fed onto a rotary casting roll, and is cooled in a temperature range of from melting point to 1000° C. at a cooling rate of 300° C. per second or more, preferably 500° C. per second or more, and further cooled in a temperature range of from 800 to 600° C. at a cooling rate of 1° C./second or less, preferably 0.75° C. per second or less.

There is also provided a method for producing a magnet, characterized in that the inventive cast alloy or the cast alloy according to items (1) or (2), mentioned above, is crushed and pulyerized into powder, and the powder is compacted under magnetic field and then sintered, as well as a method for producing a magnet, characterized in that the inventive cast alloy of the cast alloy according to items (3) or (4) is crushed and pulyerized into a first powder, the first powder and the second powder which contains iron and rare earth elements in an amount greater than the first powder are mixed together, and the powder mixture is compacted under magnetic field and sintered.

The present inventors gave consideration to the relationship between the structure of the R-T-B alloy and the magnetic properties, and attained the present invention. The facts discovered by the present inventors reside in that: in the strip-casting method of the magnet alloy, the residual magnetization is enhanced by means of controlling the cooling condition in such a manner as to decrease the volume fraction of the R-rich phase; and, further the volume fraction of R-rich phase is decreased by means of heat-treating after casting. When the cast alloy is processed to provide a magnet and the evaluation of the magnetic properties is conducted, the enhancement of the residual magnetization is recognized.

The above facts are also recognized in the two-alloy blending method, in which the main-phase alloy is strip cast.

According to the previous elucidation of the R-rich phases, they are present at the grain boundaries of the R-T-B magnet alloy which may or may not be strip cast alloy, and, in order to uniformly and finely disperse the R-rich phases, the spacing between them should be decreased, that is, the grain size of main-phase crystals should be decreased. Contrary to this, according to the inventors' discovery, the R-rich phases and grain boundaries of the main phase do not necessarily coincide with one another, and improved magnetic properties are attained by increasing the grain size of the cast alloy, decreasing spacing between the adjacent R-rich phases, and such structure can be formed by means of controlling the cooling condition of an ingot in the casting process.

A cast alloy according to the present invention contains R (at least one rare-earth element including yttrium), T (transition element but iron being essential) and B, as the basic elements, and has a low volume fraction of the R-rich phases, an optimum spacing between the adjacent R-rich phases (hereinafter referred to as "the inter-R rich phase spacing") and controlled grain size of the $R_2Fe_{14}B$ phases.

The magnet produced by using the cast alloy has high residual magnetization ($B_r$).

A method for producing a cast alloy, which contains R (at least one rare-earth element including yttrium), T (transition element but iron being essential) and B, as the basic elements, according to the present invention controls the solidification condition and cooling rate or heat-treatment after the casting in such a manner that the volume fraction of the R-rich phases is decreased, the inter-R-rich phase spacing is optimized, and the grain size of the $R_2Fe_{14}B$ phases is controlled.

Before describing the present invention the ordinary main-phase alloy is described. This alloy has a somewhat R-rich composition as compared with the stoichiometric $R_2Fe_{14}B$ composition and undergoes the solidification and structural changes in the heat treatment as is described for an example of a ternary Nd—Fe—B magnet.

In conventional solidification using a metal mold, the cooling rate is particularly slow in the vicinity of the center, i.e., a half of the thickness of an ingot. The primary α—Fe crystals are first formed and the co-existence of the two phases, that is, the liquid phase and the primary α—Fe crystals, is realized in the center of an ingot. The $Nd_2Fe_{14}B$ phase is then formed by the peritectic reaction of the α-phase at 1155° C. Since the peritectic reaction speed is slow, the unreacted primary α—Fe crystals remain in the $Nd_2Fe_{14}B$ phase. Following the subsequent temperature-fall, the $Nd_2Fe_{14}B$ phase is further formed from the liquid phase, the volume fraction of the liquid phase correspondingly decreases and the composition of the liquid phase shifts to the Nd-rich side. Finally, the liquid phase solidifies at 665° C. at the ternary eutectic reaction to form three $Nd_2Fe_{14}B$, Nd-rich and B-rich phases.

Now, in the case of the strip-casting method, since the solidification rate is so high as to super-cool the alloy melt is down below the peritectic reaction temperature, as described above, the formation of primary α—Fe crystals is suppressed and the $Nd_2Fe_{14}B$ phase can be directly formed from the liquid phase. A subsequent cooling is also so rapid that the solidification completes before complete formation of the $Nd_2Fe_{14}B$ phase. The volume fraction of $Nd_2Fe_{14}B$ phase is smaller than that predicted from the equilibrium diagram. In addition, the Nd-rich phase, which is formed at high cooling rate, has a lower Nd concentration than that predicted by the equilibrium phase diagram. The volume fraction of Nd-rich phase is high as a result of the low volume fraction of $Nd_2Fe_{14}B$ phase.

Although the descriptions in the preceding two paragraphs are related to an example of the ternary Nd—Fe—B, they can be expanded to the general R-T-B, that is, similar changes occur but for a slight variation in the reaction temperature and the like.

The present invention is now described in detail.

(1) Volume Fraction of the Main Phase and the Ternary Phase

The volume fraction of the main phase, i.e., the $R_2Fe_{14}B$ phase, and the ternary phase (V), which is at least one ternary phase except for the $R_2T_{14}B$ phase and the R-rich phase, is more than 138−1.6r ("r" is the content of R in terms of weight %).

As is described above, in the conventional strip-casting method, the volume fraction of the R-rich phase is greater and the volume ratio of the $R_2Fe_{14}B$ phase is smaller than that predicted by the equilibrium. A characterizing structure according to the present invention is that formation of primary α—Fe crystals is suppressed, the volume fraction of the R-rich phase is low, volume fraction of the main phase is high and the R-rich phases are finely dispersed. This characterizing structure is obtained by optimizing the cooling condition in the strip-casting.

The present inventors paid attention not only to the roles (1), (2) and (3) mentioned above but also to another role of the R-rich phase of the cast alloy. That is, the volume fraction of the R-rich phase exerts an influence upon residual magnetization of a magnet in such a manner that it becomes higher at a lower volume fraction of the R-rich phase, as long as such fraction is sufficient for maintaining the sintering property.

In accordance with the decrease in the R content, the volume fraction of the R-rich phase decreases and the volume fraction of the main phase (V') increases. The volume fraction (V) of the main phase and the ternary phase which brings about the effects of the present invention is dependent upon "r", which is weight % of the rare earth element and is greater than 138−1.6r. When "r" is relatively as high as approximately 30% by weight or more, the volume fraction of the main phase (V') is preferably more than 138−1.6r and less than 95%.

According to an embodiment of the present invention, the cast alloy according to the present invention can be used in the two-alloy blending method. In this embodiment, the cast alloy according to the present invention and another alloy(s) which contain iron and rare earth elements in an amount essentially greater than said cast alloy are mixed together to provide a composition of the magnet. In this embodiment, the content of rare-earth element of the main-phase alloy is usually as low as 30% by weight or less. In this case, the volume fraction (V') is preferably more than 91% (V'>91), more preferably more than 93% (V'>93). Note that said another alloy(s) is the boundary-phase alloy which has a structure greatly different from the inventive cast alloy. The volume fraction mentioned above is therefore not at all applied to the boundary-phase alloy.

According to Japanese Unexamined Patent Publication No. 7-176,414, when the R-rich phase of the main-phase alloy is decreased, the sintering property is readily impaired and hence the residual magnetization is decreased. The present inventors discovered, however, that there is a range of the R-rich phase, in which the sintering property is maintained notwithstanding a decrease in such phase, and, further, the residual magnetization is enhanced with a decrease in the R-rich phase.

(2) Average grain size of the $R_2T_{14}B$-phase

The average grain size of the $R_2Fe_{14}B$ phase is characterized by being from 10 to 100 pm measured in the direction of a short axis. When the average grain size of the main phase is 10 μm or less in the cast alloy, and, when the cast alloy is finely pulyerized to a particle diameter in the range of from 3 to 5 μm for the purpose of compacting under a magnetic field, the proportion of powder particles, in which a crystalline grain boundary is present, becomes high in the entire powder. Two or more crystals or grains having a different orientation are, therefore, present in a single particle, thereby decreasing the orientation and residual magnetization of a magnet. It is, therefore, convenient that the average grain size of the $R_2Fe_{14}B$ phase is large. However, at more than 100 μm, the high-rate cooling effect due to strip-casting is so weakened that such drawbacks as precipitation of α—Fe are incurred. When r is relatively as high as approximately 30% by weight or more, the average crystal-grain size of $R_2Fe_{14}B$ is preferably from 10 to 50 μm, more preferably from 15 to 35 μm. On the other hand, when the inventive cast alloy is used as the main-phase alloy in the two-alloy blending method and has a relatively low "r" content, the average grain size of $R_2Fe_{14}B$ is most preferably from 20 to 50 μm.

Each crystal grain of the main phase can be easily detected by means of polishing an alloy with Emery paper, then buff-polishing by means of alumina, diamond and the like, and observing the buff-polished surface with a magnetic Kerr effect micrograph. Under the magnetic Kerr effect microscope, the incident polarized light is reflected from the surface of the ferromagnetic body, and the polarization plane is rotated depending upon the direction of magnetization. Difference in the polarization planes of the light reflected from the respective crystal grains can be distinguished in difference in the brightness.

(3) Inter-R-rich phase spacing

The inter-R-rich phase spacing is characterized by being from 3 to 15 μm. When the inter-R-rich phase spacing is 15 μm or more in the cast alloy, and, when the cast alloy is finely pulverized to a particle diameter in the range of from 3 to 5 μm for the purpose of compacting under magnetic field, the proportion of powder particles, in which the R-rich phases are present, becomes low in the entire powder. When this powder is subjected to the production process of a magnet, the following drawbacks are incurred. In the compaction under the magnetic field, the dispersion of the R-rich phases is poor in the green compact. The sintering property of this green compact is poor. The magnetized sintered product has locally low coercive force due to segregation of the R-rich phase. As a result the squareness ratio is low.

On the other hand, when the inter-R-rich phase spacing is 3 μm or less, the solidification rate, under which such narrow inter R-rich phase spacing is formed, is too high. Under such high solidification rate, grain size of the main phase is detrimentaly refined. When "r" is relatively as high as approximately 30% by weight or more, the inter R-rich phase spacing is preferably from 3 to 10 μm, more preferably from 3 to 8 μm. On the other hand, when the inventive cast alloy is used as the main-phase alloy of the two-alloy blending method and has a relatively low "r" content, the inter R-rich phase spacing is most preferably from 5 to 12 μm.

The R-rich phase can be detected by means of polishing an alloy with Emery paper, then buff-polishing by means of alumina, diamond and the like, and subjecting the buff-polished surface to observation with a scanning-type electron microscope (SEM) to observe the back scattered electron image. Since the R-rich phase has a greater atomic number than the main phase, the back scattered electron image from the R-rich phase is brighter than that from the main phase. The average inter-R-rich phase spacing can be obtained by the following observation and calculation methods. For example, a cross-section of a strip is observed. In this observation, a line is drawn parallel to the surface of a strip a central axis at a half of the thickness, the number of the R-rich phases, which intersect the line, is counted, and the length of line segments is divided by the calculated number.

(4) Production Method

One of the production methods is characterized in the strip-casting method. Particularly, the average cooling rate in a temperature range of from the melting point to 1000° C. is set to 300° C./second or more, preferably 500° C./second or more, and the cooling rate from 800 to 600° C. is set to 1° C./second or less, preferably 0.75° C./second or less.

It is possible to produce the alloy in the form of a thin strip free of α—Fe by means of strip-casting. Recently, the strip-casting apparatus has been modified to improve the productivity.

The solidification rate and the cooling rate in a high temperature range down to the vicinity of the peritectic temperature exert influence upon the grain size and formation of the α—Fe. Slow cooling rate is preferable for obtaining large grain size, while rapid cooling rate is rather preferable for preventing the α—Fe from forming. The inter-R-rich phase spacing is dependent upon the cooling rate in the high temperature region and also upon the cooling rate in a low-temperature region close to the eutectic temperature. For example, the inter-R-rich phase spacing becomes smaller, and the dispersion of the R-rich phases become finer, when the cooling rates are higher. There is, therefore, an optimum cooling condition for obtaining the optimum structure.

Knowledge was obtained as a result of extensive studies that average cooling rate from the melting point to 1000° C. should be 300° C./second or more. At a cooling rate of less than 300° C./second, the α—Fe is formed, the inter-R-rich phase spacing is wide, and the structure is not fine.

One of the most greatly influential factors on the strip-cooling rate before separation from a casting roll is the thickness of a strip. The thickness of the strip should be from 0.15 to 0.60 mm, preferably from 0.20 to 0.45 mm to attain an average cooling rate in a temperature range of from the melting point to 1000° C. amounting to 300° C./second or more and to form the structure in which the grain size and the inter R-rich phase spacing are optimum. When the thickness of a strip is less than 0.15 mm, the solidification rate is so high that the grain size is less than the preferable range. Although an accurate measurement of the cooling rate is difficult, the cooling rate can be obtained by the following simple method. The temperature of a strip immediately after separation from the casting roll can be easily measured and lies in a range of from approximately 700 to 800° C. When the temperature-fall value is divided by the time period from supplying of melt onto the casting roll, via strip separation until the temperature measurement, then, the average cooling rate in this temperature range can be obtained. The average cooling rate in a temperature range of from the melting point to 800° C. can be obtained by this method. In the ordinary solidification and cooling process including the process of the present invention, the cooling rate is higher in a higher temperature-range. Therefore, if the average cooling rate from the melting point to 800° C. obtained by the above method is confirmed to be 300° C./second or more, it can be said that the cooling rate from the melting point to 1000° C. is also 300° C./second or more. Although the accurate, upper limit of the cooling rate is difficult to define, the cooling rate of approximately $10^{4}$° C./second or less seems to be preferable.

Since the cooling rate in the strip-casting is as high as hundreds to thousands ° C./second, the volume fraction of the R-rich phases in the obtained strip is higher than that predicted by an equilibrium phase diagram. Such structure has been heretofore recognized and accepted as the preferable one. However, the volume ratio of R-rich phase is low in the present invention, because the cooling rate in a temperature range of from 800 to 600° C. is 1° C./second or less. This relatively low cooling rate contributes to promote the formation of the $R_2T_{14}B$ phase from the melt remaining in the temperature range of from 800 to 600° C. for a longer time. When the cooling rate in the temperature range of from 800 to 600° C. exceeds 1.0° C./second, the solidification completes while separation of the the $R_2T_{14}B$ phase out from the liquid R-rich phase is incomplete. The R-rich phase remains, therefore, in excessive amount and the objects of the present invention are not attained.

In addition, the cooling-rate control described above has an effect to provide appropriately wide spacing between the R-rich phases.

According to the present invention, the temperature, at which a strip falls down from the casting roll, is set at 700° C. or higher, and appropriate temperature-holding step is subsequently carried out, thereby enabling the cooling rate to be controlled in a range of from 800 to 600° C.

The other production method, which attains the same effects as by the already described method, is characterized in a strip-casting method and heat-treatment, in which a cast and cooled strip is heat-treated at 600 to 800° C. This heat-treatment temperature is lower than the homogenizing heat-treatment having the purpose for diminishing the α—Fe. Since the cast strip is thin, heat treatment time for at least 10 minutes is usually satisfactory. Heat treatment time longer than 3 hours is unnecessary. The heat treatment time according to the present invention is, therefore, shorter than that of the homogenzing treatment. The heat-treatment atmosphere must be vacuum or inert gas so as to prevent the strip from being oxidized. Cooling after the heat treatment down to approximately 600° C. is preferably carried out slowly. An apparatus for implementing the inventive heat treatment is, therefore, advantageous in the light of investment and cost than the homogenizing treating apparatus.

Incidentally, recently reported several inventions concerning the strip cast material are referred.

According to the invention disclosed in Japanese Unexamined Patent Publication No. 8-269,643, desired structure is obtained by specifying the cooling rate, as well. The melt is subjected to primary cooling by means of a roll at a rate of from $2\times10^{3\circ}$ C./second to $7\times10^{3\circ}$ C./second. After cooling to the strip temperature of from 700 to 1000° C. and separation of a cast strip from the roil, the cast strip is subjected to the secondary cooling at a cooling rate of from $50–2\times10^{3\circ}$ C./second down to a temperature at or lower than the solidus temperature. The thus formed structure is that: the $R_2T_{14}B$ phases have an average short-axis diameter of from 3 to 15 μm; the R-rich phase is 5 μm or less in size; and, the $R_2T_{14}B$ phases and the R-rich phases are finely dispersed. Aledgedly, a high orientation degree can be maintained, and the pulyerized powder does not contain easily oxidizable extremely fine particles. As a result, the magnetic properties can be successfully enhanced.

Now again regarding to the present invention, the cooling rate during the casting is controlled also in the divided, high-temperature and low-temperature regions, so as to form desirable structure and hence enhance the magnetic properties. The alloy structure provided by the present invention is, however, different from that of Japanese Unexamined Patent Publication No. 8-269,643 in the points that: the average grain size of the $R_2T_{14}B$-phase is from 10 to 100 μm in the former and from 3 to 15 μm in the latter; and, the inter R-rich phase spacing is from 3 to 15 μm in the former and not at all specified in the latter, which merely discloses the size of the R-rich phases. Regarding the secondary cooling, which partially overlaps the low-temperature range of the present invention, Japanese Unexamined Patent Publication No. 8-269,643 discloses that when the cooling rate is slow, the grain growth occurs, which incurs the iHc decrease of the sintered magnet. A preferable secondary cooling rate is from 50° C./minute to $2\times10^{3\circ}$ C./minute in Japanese Unexamined Patent Publication No. 8-269,643. This preferable highest cooling rate is set in the light of productivity but not from the magnetic properties. Contrary to this, the inventive control of cooling rate in the high and low-temperature ranges attains a large grain size of the $R_2T_{14}B$-phase, narrow inter R-rich phase spacing, and small volume fraction of the R-rich phases. For example, the cooling rate in the low-temperature region of from 800 to 600° C. is as slow as 1° C./sec or less, and hence is considerably less than the highest secondary cooling rate of Japanese Unexamined Publication No. 8-269,643, i.e., 2×10° C./min (33.3° C./sec). This publication does not disclose at all the effectiveness of the post-casting heat treatment.

According to the invention disclosed in Japanese Unexamined Patent Publication No. 8-264,363, a thin strip cast alloy obtained by the strip casting method is heat treated at 800–1100° C. to remove the hardened surface layer and to accelerate the disintegration of alloy and powder-refinement in the succeeding hydrogen-absorbing step. The alloy structure is not defined in Japanese Unexamined Patent Publication No. 8-264,363. A preferable range of heat treatment is different from the inventive range of from 600 to 800° C.

The volume fraction and dispersion state of R-rich phases exert an influence upon the residual magnetization of a magnet probably because of the following reasons. When the volume ratio of the R-rich phases is high, they are under non-equilibrium state. When roughly crushed alloy is subjected to the hydrogen decrepitation process, which is usually employed in the production of magnet, the R-rich phase preferentially absorbs hydrogen and embrittles. Cracks therefore preferentially generate in and propagate along the R-rich phases. The volume fraction and dispersion state of R-rich phases therefore exert an influence upon the shape of finely pulyerized powder and its particle-size distribution. It is confirmed that, when the inter R-rich phase spacing is approximately 3 μm or less, the powder shape tends to be angular. It is presumed that the orientation degree of finely pulyerized powder at the compacting under magnetic field is influenced by its size and particle size distribution.

Figure 1:
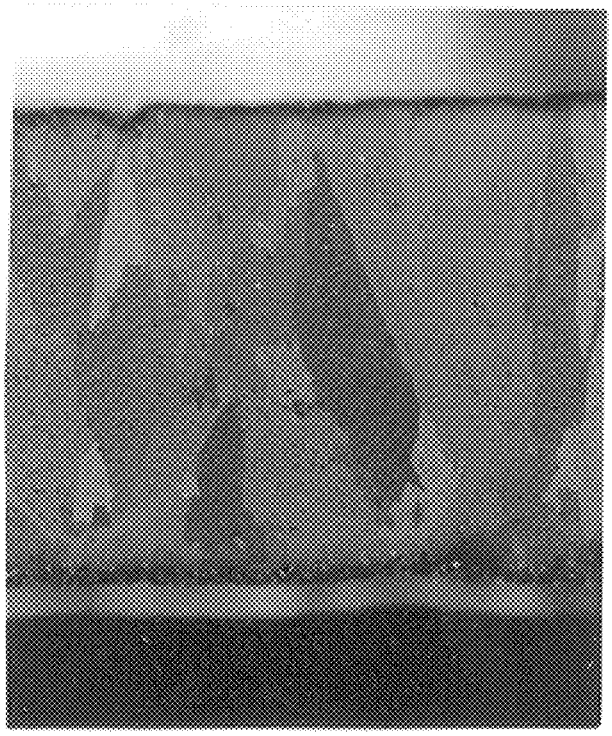
FIG. 1 is a photograph of a magnetic Kerr effect micrograph showing the grain size of the alloy produced in Example 1 (magnification 200 times)
Figure 2:
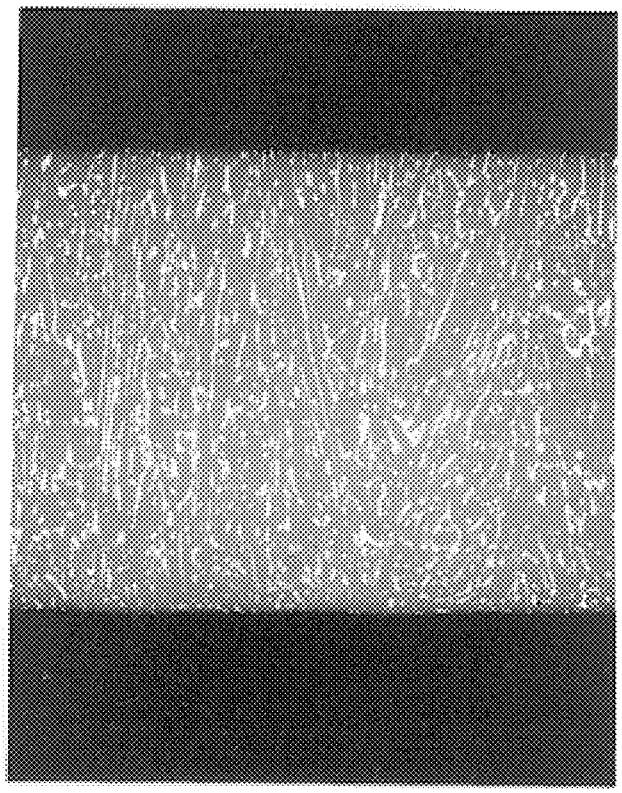
FIG. 2 is a photograph of a back scattered electron image showing the dispersion of R-rich phases of the alloy produced in Example 1 (magnification 200 times)
Figure 3:
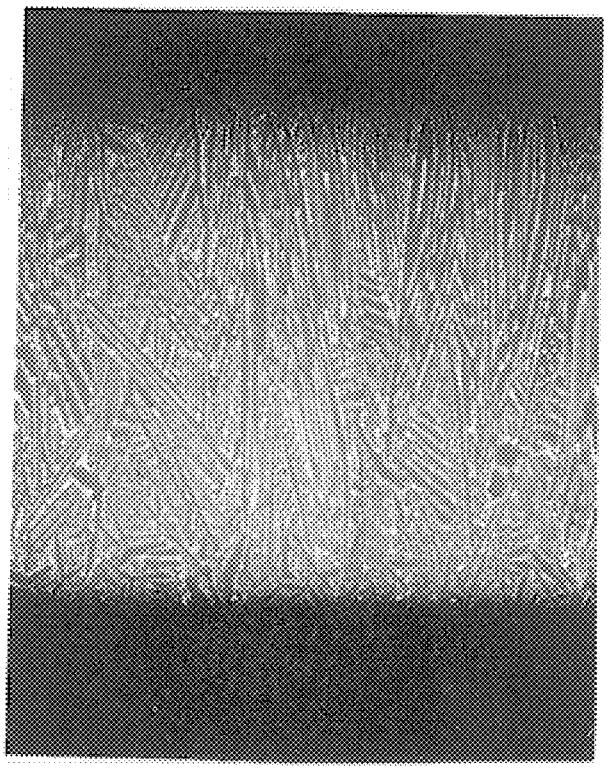
FIG. 3 is a photograph of a back scattered elecctron image showing the dispersion of R-rich phases of the alloy produced in Comparative Example 1 (magnification 200 times)
Figure 4:
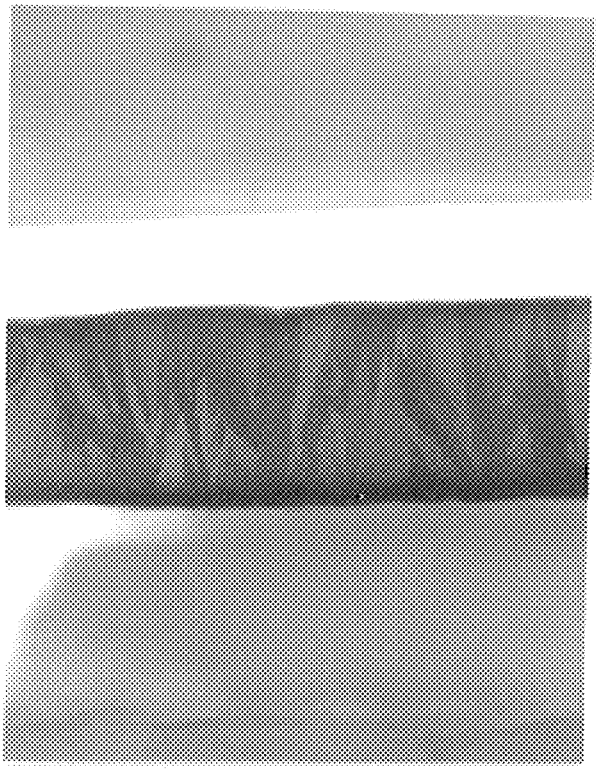
FIG. 4 is a photograph of a magnetic Kerr effect micrograph showing the grain size of the alloy produced in Comparative Example 2 (magnification 200 times)

The present invention is hereinafter described with reference to the examples and comparative examples.

EXAMPLE 1

Iron-neodymium alloy, metallic dysprosium, ferro-boron, cobalt, aluminum, copper and iron were used to provide an alloy composition consisting of 30.7% by weight of Nd, 1.00% by weight of B, 2.00% by weight of Co, 0.30% by weight of Al, 0.10% by weight of Cu, and the balance of Fe. The starting materials were melted in the alumina crucible by a high-frequency vacuum induction furnace, under the argon-gas atmosphere. An approximately 0.33 mm thick strip was formed by the strip-casting method. A high-temperature strip separated from the casting roll was held for 1 hour in a box made of highly heat-insulating material. The strip was then admitted into a box having water-cooling structure to quench the strip to room temperature. The temperature change of the strip in the heat insulating box was measured by a thermo-couple situated in the box. The result was that, when the strip fell down into the heat-insulating box, its temperature was 710° C. Eight minutes then lapsed until the temperature reached at 600° C. Since the time required for cooling from 800° C. to 710° C. is negligibly short, the average cooling rate from 800 to 600° C. is virtually 0.56° C. per second and is actually less than this value. The cooling rate from the melting point to 1000° C. is calculated from the time lapsed until the strip falling down into the heat-insulating box, and is more than 400° C. per second. Meanwhile, temperature of a strip on the casting roll was measured by a radiation thermometer. This indicated that the cooling rate from the melting point to 1000° C. was more than 1000° C. per second.

The cross section of the resultant strip was observed by a magnetic Kerr effect micrograph. This indicated that the average grain size of the main phase, i.e., $R_2T_{14}B$ phase, was approximately 28 $\mu$m. The back scattered electron image of a scanning-type electron microscope was also observed. This observation revealed that the R-rich phases are present along the boundaries and within the grains of the main phases. The morphology of the R-rich phases is stripe form or partially granular. The inter R-rich phase spacing was approximately 5 $\mu$m. A slight amount of the rare-earth element poor phases, which seem to be the B-rich phases, was also present. The volume fraction (V') of the main phase, i.e., the $R_2Fe_{14}B$ phase, was measured utilizing an image-processor and revealed to be 91%. The volume fraction (V) of the main phase and ternary phase was 92%.

Hydrogen was absorbed in the resultant alloy at room temperature and then desorbed from the alloy at 600° C. The resultant powder was roughly crushed by means of Brown mill to obtain milled alloy powder having 0.5 mm or less of particle size. The roughly crushed powder was then finely pulverized by a jet mill to obtain the magnet powder having 3.5 $\mu$m of average particle diameter. The resultant powder was compacted under a magnetic field of 15 kOe and pressure of 1.5 ton/cm$^2$. The resultant green compact was sintered at 1050° C. for 4 hours. The two-step heat treatment was then carried out at 850° C. for 1 hour and 520° C. for 1 hour. The magnetic properties of the magnet produced are shown in Table 1.

COMPARATIVE EXAMPLE 1

The same composition as in Example 1 was strip cast by the same strip-casting method as in Example 1 to produce a 0.3 mm thick alloy strip. A high-temperature strip separated from the casting roll was directly admitted into a box having water-cooling structure to quench the strip to room temperature. The temperature change of the strip in the box was measured by a thermo-couple situated in the box. When the strip fell down into the box, its temperature was 710° C. Fifteen seconds then lapsed until the temperature reached 600° C. Since the time required for cooling from 800° C. to 710° C. is shorter than the time lapsed until the strip's falling down into the box and is approximately 2 seconds at the longest. This time is added to the fifteen seconds to calculate the average cooling rate from 800 to 600° C. This is virtually 12° C. per second and is actually greater than this value. Meanwhile, the cooling rate from the melting point to 800° C. is the same as in Example 1.

A cross-section of the resultant strip was observed by a magnetic Kerr effect micrograph. This indicated that the average grain size of the main phase, i.e., the $R_2Fe_{14}B$ phase, was approximately 28 $\mu$m. A back scattered electron image of a scanning-type electron microscope was also observed. This observation revealed that the R-rich phases are present along the boundaries and within the grains of the main phases. The morphology of the R-rich phases is a stripe form or partially granular. The inter R-rich phase spacing was approximately 2 $\mu$m. The volume fraction (V') of the main phase, i.e., the $R_2Fe_{14}B$ phase, was measured utilizing an image-processor and revealed to be 87%. The volume fraction (V) of the main phase and ternary phase was also 87%.

A sintered magnet was produced by using the alloy produced as above by the same method as in Example 1. The magnetic properties of the magnet are shown in Table 1.

EXAMPLE 2

The same composition as in Example 1 was strip-cast by the same strip casting method as in Example 1 to produce a 0.33 mm-thick strip. A high-temperature strip separated from the casting roll fell in a box made of the same highly heat-insulating material as in Example 1. The strip was extended broadly in the box in such a manner that the entire lower surface is placed on the box bottom. The strip was held for 1 hour in the box while maintaining the extended form. The strip was then admitted into a box having a water-cooling structure to quench the strip to room temperature. The temperature change of the strip in the heat-insulated box was measured by a thermo-couple situated in the box. When the strip fell down into the heat-insulating box, its temperature was 710° C. Four minutes then lapsed until the temperature reached 600° C. The average cooling rate from 800 to 600° C. is 0.80° C. per second or less. The cooling rate from the melting point to 800° C. is the same as in Example 1.

A cross section of the resultant strip was observed by a magnetic Kerr effect micrograph. This indicated that the average crystal-grain diameter of the main phase, i.e., $R_2T_{14}B$ phase, was approximately 28 $\mu$m. A back scattered electron image of a scanning-type electron microscope was also observed. This observation revealed that the R-rich phases are present along the boundaries and within the grains of the main phases. The morphology of the R-rich phases is a stripe form or partially granular. The inter R-rich phase spacing was approximately 4 $\mu$m. The volume fraction (V') of the main phase, i.e., the $R_2Fe_{14}B$ phase, was measured utilizing an image-processor and revealed to be 90%. The volume fraction (V) of the main phase and ternary phase was 91%.

A sintered magnet was produced by using the alloy produced as above by the same method as in Example 1. The magnetic properties of the magnet are shown in Table 1.

COMPARATIVE EXAMPLE 2

The same composition as in Example 1 was strip-cast by the same strip-casting method as in Example 1 to produce an alloy strip to be used as the main-phase alloy. However, the thickness of a strip was approximately 0.13 mm because the melt feeding rate was decreased and the circumferential speed of the casting roll was increased twice as compared with the case in Example 1.

A high-temperature strip separated from the casting roll was held for 1 hour in a box made of the heat-insulating material as in Example 1. The strip was then admitted into a box having a water-cooling structure to quench the strip to room temperature. The temperature change of the strip in the heat-insulated box was measured by a thermo-couple situated in the box. When the strip fell down into the heat-insulated box, its temperature was 630° C. Three minutes then lapsed until the temperature reached 600° C. The average cooling rate from 800 to 600° C. is therefore 1.1° C. per second or less. The cooling rate from the melting point to 800° C. is 500° C. per second or more.

A cross section of the resultant strip was observed by a magnetic Kerr effect micrograph. This indicated that the average grain size of the main phase, i.e., the $R_2Fe_{14}B$ phase, was approximately 9 μm. A back scattered electron image of a scanning-type electron microscope was also observed. This observation revealed that the R-rich phases are present along the boundaries and within the grains of the main phases. The morphology of the R-rich phases is a stripe form or partially granular. The inter-R-rich phase spacing was approximately 4 μm. The volume fraction (V') of the main phase, i.e., the $R_2Fe_{14}B$ phase, was measured utilizing an image-processor and revealed to be 90%. The volume fraction (V) of the main phase and ternary phase was 91%.

COMPARATIVE EXAMPLE 3

The same composition as in Example 1 was cast into an iron mold having a water-cooling structure so as to form a 25 mm thick ingot. The cross-sectional structure of the ingot was measured using a magnetic Kerr effect micrograph. The average grain size of the main phase, i.e., the $R_2Fe_4B$ phase, was approximately 150 μm. However, when a back scattered electron image of a scanning-type electron microscope was observed, a large amount of α—Fe is present in the entire ingot. This ingot did not therefore serve for the production of a magnet.

EXAMPLE 4

The alloy composition was the same as in Example 1 except that the Nd and Dy contents were 30.8% by weight and 1.2% by weight, respectively. This alloy composition was strip cast by the same method as in Example 1 to form an approximately 0.33 mm thick alloy strip. A sintered magnet was produced by the same method as in Example 1. The cooling rate, alloy structure and properties of the sintered magnet are shown together in Table 1.

EXAMPLE 5

The two-alloy blending method was carried out in this example. The main in-phase alloy, which consisted of 28.0% by weight of Nd, 1.09% by weight of B, 0.3% by weight of Al, and the balance being Fe, was strip cast by the same method as in Example 1 to produce an approximately 0.35 mm thick strip. The cooling rate and alloy structure are shown in Table 1.

Meanwhile, iron-neodymium alloy, metallic dysprosium, ferro-boron, cobalt, aluminum, copper and iron were blended to provide a boundary-phase alloy composition consisting of 38.0% by weight of Nd, 10.0% by weight of Dy, 0.5% by weight of B, 20% by weight of Co, 0.67% by weight of Cu, 0.3% by weight of Al, and the balance being Fe. The alloy composition was melted by using the alumina crucible by a high-frequency induction vacuum furnace, under argon-gas atmosphere. An approximately 10 mm thick ingot was produced by the centrifugal casting method.

Subsequently, 85% by weight of the main-phase alloy and 15% by weight of the boundary phase alloy were mixed and then subjected to hydrogen absorption at room temperature, followed by hydrogen desorption at 600° C. The resultant powder mixture was roughly crushed by a Brown mill to obtain an alloy powder having particle size of 0.5mm or less. This powder was then finely pulverized by a jet mill to obtain magnet powder having average particle size of 3.5 μm. The resultant fine powder was compacted under a magnetic field of 15 kOe and pressure of 1.5 ton/cm$^2$. The resultant green compact was sintered at 1050° C. for 4 hours in vacuum. The sintered compact was subjected to the first-stage heat-treatment at 850° C. for 1 hour and the second-stage heat-treatment at 520° C. for 1 hour. The magnetic properties of the magnet produced as above are shown in Table 1.

COMPARATIVE EXAMPLE 5

The main-phase alloy having the same composition as in Example 5 was strip cast by the same method as in Example 5 to form an approximately 0.35 mm thick strip. However, in the strip casting method, the strip separated from the casting roll was directly admitted into a box having a water-cooling structure, so as to quench the strip to room temperature. The cooling rate and the alloy structure of the strip are shown in Table 1

The main-phase alloy produced in this comparative example and the boundary-phase alloy produced in Example 5 were used to produce a sintered magnet by the same method as in Example 5. The magnetic properties of the sintered magnet are shown in Table 1.

As is described hereinabove, a strong permanent magnet having the maximum energy product (BH) max amounting to 40 MGOe or more can be easily obtained.

TABLE 1

| | | Average Cooling Rate | | | Structure | | | | Magnetic Properties | | | |
|---|---|---|---|---|---|---|---|---|---|---|---|---|
| | R Content | Melting Point- | Melting Point- | 800– | | | Main Phase Average Grain | Inter-R-rich Phase | | | | |
| | r (wt %) | 1000° C. (° C./sec) | 800° C. (° C./sec) | 600° C. (° C./sec) | V (%) | V' (%) | Size (μm) | Spacing (μM) | Br (kG) | iHc (kOe) | $(BH)_{max}$ (MGOe) | Remarks |
| Example 1 | 30.7 | >1000 | >400 | <0.56 | 92 | 91 | 28 | 5 | 13.6 | 12.0 | 44.3 | |
| Example 2 | 30.7 | Unmeasured | >400 | <0.80 | 91 | 90 | 28 | 4 | 13.5 | 12.2 | 43.6 | |
| Example 4 | 32.0 | Unmeasured | >400 | <0.69 | 90 | 89 | 25 | 5 | 13.0 | 15.5 | 40.2 | |
| Example 5 | 28.0 | Unmeasured | >400 | <0.33 | 95 | 94 | 35 | 8 | 13.1 | 14.3 | 40.8 | Two-Alloy Blending |
| Comparative Example 1 | 30.7 | Unmeasured | >400 | >12 | 87 | 87 | 28 | 2 | 13.2 | 12.2 | 41.9 | |

TABLE 1-continued

| | R Content | Average Cooling Rate | | | Structure | | | | Magnetic Properties | | | |
|---|---|---|---|---|---|---|---|---|---|---|---|---|
| | | Melting Point- | Melting Point- | 800– | | | Main Phase Average Grain | Inter-R-rich Phase | | | | |
| | r (wt %) | 1000° C. (° C./sec) | 800° C. (° C./sec) | 600° C. (° C./sec) | V (%) | V' (%) | Size (μm) | Spacing (μM) | Br (kG) | iHc (kOe) | $(BH)_{max}$ (MGOe) | Remarks |
| Comparative Example 2 | 30.7 | Unmeasured | >500 | <1.1 | 91 | 90 | 9 | 4 | 13.3 | 12.1 | 42.2 | |
| Comparative Example 3 | 30.7 | Metal-Mold Casting | | | * | * | 150 | 30 | — | — | — | Fe is present |
| Comparative Example 5 | 28.0 | Unmeasured | >400 | 12 | 87 | 87 | 35 | 3 | 12.6 | 14.4 | 38.0 | Two-Alloy Blending |

V: Volume Fraction of Main Phase and Ternary Phase
V': Volume Fraction of Main Phase In Examples 5 and Comparative Example 5, the R content, cooling rate and structure are those of the main-phase alloy.

We claim:

1. A method of producing a cast alloy, comprising:

feeding a melt onto a rotary casting roll, the melt comprising from 27 to 34% by weight of at least one element selected from the group consisting of the rare earth elements (R) and yttrium, from 0.7 to 1.4% by weight of boron, with the balance being essentially iron, and optionally other transition elements; cooling the melt in a temperature range of from melting point to 1000° C. at a cooling rate of 300° C. per second or more; and further cooling in a temperature range of from 800° C. to 600° C. at a cooling rate of 0.80° C./second or less.

2. A method according to claim 1, wherein the cooling rate in the temperature range of from melting point to 1000° C. is 500° C. per second or more, and, further the cooling rate in the temperature range of from 800° C. to 600° C. is 0.75° C. per second or less.

3. A method for producing a magnet, comprising:

crushing and pulyerizing a cast alloy into powder;

compacting the powder under a magnetic field; and sintering the compacted power, wherein the cast alloy is obtained by:

feeding a melt onto a rotary casting roll, the melt comprising from 27 to 34% by weight of at least one element selected from the group consisting of the rare earth elements (R) and yttrium, from 0.7 to 1.4% by weight of boron, with the balance being essentially iron, and optionally other transition elements;

cooling the melt in a temperature range of from melting point to 1000° C. at a cooling rate of 300° C. per second or more; and further cooling in a temperature range of from 800° C. to 600° C. at a cooling rate of 0.80° C./second or less.

4. A method for producing a magnet, comprising:

crushing and pulyerizing a cast alloy into a first powder;

mixing the first powder with a second powder which contains mainly iron and rare earth elements in an amount greater than the first powder;

compacting the powder mixture under magnetic field; and then sintering the compacted powder mixture;

wherein the cast alloy is obtained by:

feeding a melt onto a rotary casting roll, the melt comprising from 27 to 34% by weight of at least one element selected from the group consisting of the rare earth elements (R) and yttrium, from 0.7 to 1.4% by weight of boron, with the balance being essentially iron, and optionally other transition elements;

cooling the melt in a temperature range of from melting point to 1000° C. at a cooling rate of 300° C. per second or more; and further cooling in a temperature range of from 800° C. to 600° C. at a cooling rate of 1° C./second or less.

* * * * *